United States Patent [19]

Fujinuma et al.

[11] Patent Number: 4,491,763

[45] Date of Patent: Jan. 1, 1985

[54] COLOR PICTURE TUBE WITH SHADOW MASK SUPPORTING MEMBERS

[75] Inventors: Makoto Fujinuma, Fukaya; Masaomi Futatsudera, Saitama; Makoto Harigae, Fukaya, all of Japan

[73] Assignee: Tokyo Shibaura Denki Kabushiki Kaisha, Kawasaki, Japan

[21] Appl. No.: 413,440

[22] Filed: Aug. 31, 1982

[51] Int. Cl.[3] ..... H01J 29/07

[52] U.S. Cl. ..... 313/405; 313/406; 313/407

[58] Field of Search ..... 313/406, 407, 405, 404

[56] References Cited

U.S. PATENT DOCUMENTS 3,898,508 8/1975 Pappadis ..... 313/407 X

FOREIGN PATENT DOCUMENTS 2701150 7/1978 Fed. Rep. of Germany ..... 313/405

1304567 1/1973 United Kingdom ..... 313/406

*Primary Examiner*—Palmer Demeo

*Attorney, Agent, or Firm*—Cushman, Darby and Cushman

[57] ABSTRACT

A color cathode picture tube including an envelope having a fluorescent screen therein, a shadow mask assembly having a shadow mask and a mask frame for holding the shadow mask at its peripheral edge, and a shadow mask supporting member for supporting the shadow mask assembly inside the envelope. The shadow mask supporting member comprises a first metal strip having a thermal expansion coefficient substantially equal to that of the mask frame, a second metal strip joined to the first metal strip at one side thereof so that their respective faces may form a continuous face, this second strip having a thermal expansion coefficient higher than that of the first strip, and a third metal strip joined to the first metal strip at the other side thereof so that their respective faces may form a continuous face, the third strip having a thermal expansion coefficient lower than that of the first metal strip. The first metal strip is fixed at one end portion thereof to the mask frame and engaged at the other end portion thereof with panel pin built in the envelope.

10 Claims, 7 Drawing Figures

COLOR PICTURE TUBE WITH SHADOW MASK SUPPORTING MEMBERS

BACKGROUND OF THE INVENTION

This invention relates to a color picture tube using a shadow mask as the color selective electrode, and more particularly, to a shadow mask support member designed to support the shadow mask.

In a conventional color picture tube using a shadow mask, the shadow mask is heated to expansion during the operation due to the impact thereupon of the electron beams. This causes a variation in path of electron beams defined by the aperture of the shadow mask and allows the electron beams to pass therethrough to reach the fluorescent screen. As a result, a poor color purity occurs. For the purpose of preventing the occurrence of such a poor color purity, the shadow mask support member supporting the shadow mask so as to permit the same to be disposed approximately to the fluorescent screen inside the envelope can be constructed so that the shadow mask with an increase in the temperature thereof may be placed in proximity to the fluorescent screen, thereby compensating for the path variation of electron beams.

As a means for achieving such a compensation, two shadow mask support members are known, one of which is of such a type as disclosed in the specification of U.S. Pat. No. 3,803,436 wherein a bimetal prepared by laminating a metal plate of low-thermal expansion upon a metal plate of high-thermal expansion is used as a constituent part of the shadow mask support member, and the other of which is of such a type as disclosed in the specification of U.S. Pat. No. 3,573,527 wherein a bimetal prepared by joining a low-thermal expansion metal plate to a high-thermal expansion metal plate in side by side joined relationship to each other is used as the shadow mask support member.

Any of such known shadow mask support members is welded at one end to a mask frame arranged to hold the shadow mask in place, and is engaged directly or indirectly at the other end with a panel pin built in the inner face of the envelope. In this case, in order to secure the fixation of the shadow mask support member to the mask frame, both are welded together at a plurality of spots.

Each of the above-mentioned known shadow mask support members sufficiently performs the function of preventing the mislanding, due to a temperature rise occurring during the operation of the color picture tube, of the electron beams onto the fluorescent material radiating a particular color. It has turned out, however, that the known shadow mask support member degrades the characteristic of the color picture tube, as below, by undergoing a thermal treatment at high temperature in the process of manufacturing the color picture tube.

That is, in the manufacturing process of the color picture tube, a thermal treatment is carried out during, for example, an evacuation step at as high a temperature as 400°~450° C. which is extremely high as compared with the temperature of 70°~80° C. prevailing when the color picture tube is in operation. As a result, any of the shadow mask, mask frame and shadow mask support member is heated to expansion during said evacuation step. On the other hand, the shadow mask support member is partly or wholely constituted by the bimetal, and the metal constituting this bimetal differs from the mask frame in respect of the thermal expansion coefficient. Owing to this difference, thermal deformation occurs in the joining portion between the shadow mask support member and the mask frame. That is, since the shadow mask support member is required to support the heavy shadow mask assembly, it is spot-welded to the side wall of the mask frame at several spots. As a result, a thermal stress, owing to the difference in thermal expansion coefficient between the two, acts on the welding spots. This thermal stress becomes very high due to the thermal treatment at high temperature. Thus, it becomes possible that a permanent deformation is made in the mask frame or the shadow mask support member. Consequently, the position of the shadow mask relative to the fluorescent screen is often displaced, resulting in a lower color reproducibility of the color picture tube. Therefore, for reducing the effect of such a thermal deformation, it is necessary to perform an additional treatment of passing the intermediate product through a stabilizing oven for thermal stabilization of the same.

SUMMARY OF THE INVENTION

Accordingly, the object of the invention is to provide a color picture tube which is capable of, during the thermal treatment in the manufacturing process of the color picture tube, preventing permanent deformation from being made in the mask frame or shadow mask support member, thereby maintaining the positional relationship between the shadow mask and the fluorescent screen to be fixed.

According to the present invention, there is provided a color picture tube which comprises a shadow mask assembly including a shadow mask having a large number of apertures permitting the passage of electron beams therethrough and a mask frame for holding the shadow mask at the peripheral edge thereof, an envelope having a fluorescent screen inside the same, and shadow mask support members for supporting the shadow mask assembly so as to permit the same to oppose the fluorescent screen inside the envelope in face to face relationship. The shadow mask support member comprises a first metal strip having a thermal expansion coefficient substantially equal to that of the mask frame, a second metal strip joined to the first metal strip at one side thereof so that their respective faces may form a continuous face and having a thermal expansion coefficient higher than that of the first metal strip, and a third metal strip joined to said first metal strip at the other side thereof so that their respective faces may form a continuous face and having a thermal expansion coefficient lower than that of the first metal strip. The shadow mask support member is fixed at one end portion to the mask frame and engaged at the other end portion with a panel pin built in the inner face of the envelope.

DETAILED DESCRIPTION OF THE PREFERRED EMBODIMENTS

Figure 1:
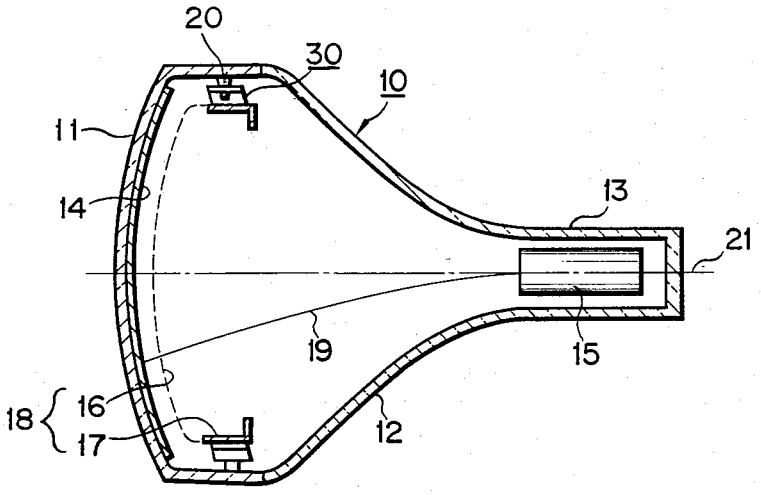
FIG. 1 is a sectional view showing the outline of a color picture tube according to an embodiment of the invention.

An embodiment of the invention will now be described with reference to the accompanying drawings. Referring to FIG. 1, an envelope 10 constituting a shadow mask type color picture tube includes a panel 11 formed, on its inner face, with a fluorescent screen 14 capable of radiating red, green and blue lights, a funnel 12 extending from the panel, and a neck portion 13 extending from the funnel and containing an electron gun 15. A shadow mask 16 made of soft-iron has a large number of circular, rectangular, or other shaped apertures and selectively causes an electron beam 19 emitted from the electron gun 15 to reach the fluorescent screen 14, thereby exciting the fluorescent material dot or stripe of a particular fluorescent color to cause it to radiate its corresponding color light. The peripheral edge of the shadow mask 16 is held by a mask frame 17 prepared by molding an iron sheet and shaping the same into, for example, a rectangular frame. The shadow mask 16 is joined to the mask frame 17 by being spot-welded thereto. The shadow mask 16 and the mask frame 17 constitute a shadow mask assembly 18. To the outer side wall of the mask frame 17 parallel to the axis of the color picture tube a shadow mask support member 30 is fixed, for example, by being welded at three or four spots to the outer side wall surface of the mask frame 17. On the other hand, in the inner face portion of the panel 11 located in the proximity of the joining portion at which the panel 11 is joined to the funnel 12, a panel pin 20 is built so as to project inwardly of the envelope. By causing the shadow mask support member 30 to engage the panel pin 20, the shadow mask assembly 18 is elastically firmly held within the envelope. Thus, the shadow mask 16 is disposed at a position approximate to, and at a prescribed interval from, the fluorescent screen 14.

Figure 2:
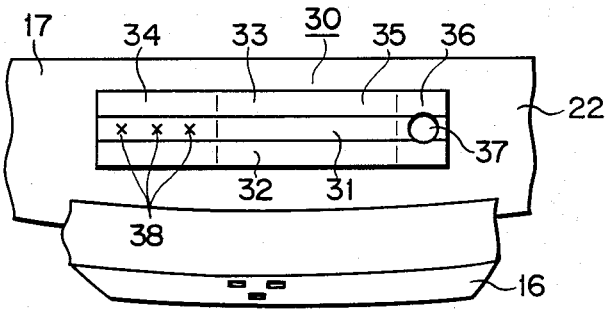
FIG. 2 is a plan view of a shadow mask support member one end of which is welded to a shadow mask assembly.
Figure 3:
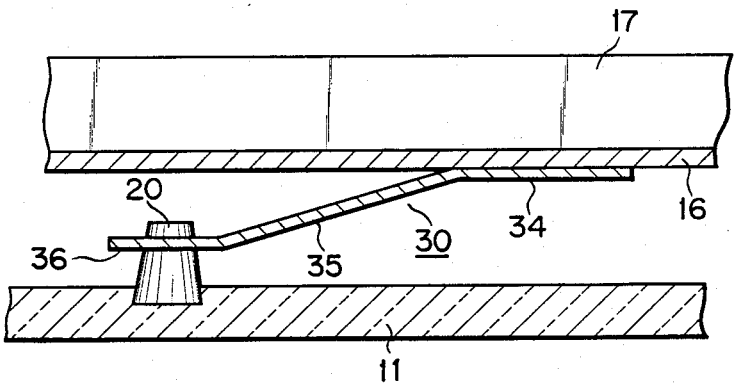
FIG. 3 is a sectional view, in main part, of the state wherein the shadow mask assembly is attached to a panel through the shadow mask support member.

FIGS. 2 and 3 respectively show a state wherein the shadow mask support member 30 is fixed to the mask frame 17. The shadow mask support member 30 includes a first elastic metal strip 31 having a thermal expansion coefficient substantially equal to that of the mask frame 17, a second metal strip 32 joined to the first elastic metal strip 31 at one side thereof and consisting of metal having a thermal expansion coefficient higher than that of the first elastic metal strip 31, and a third metal strip 33 joined to the first elastic metal strip 31 at the other side thereof and consisting of metal having a thermal expansion coefficient lower than that of the first elastic metal strip 31. The first, second and third metal strips 31, 32 and 33 are integrally joined in side by side joined relationship to each other, by, for example, seam welding, so as to form one continuous flat face, and as a whole serve as an elastic plate. A base end portion 34, and a tip end portion 36, of the shadow mask support member 30 are respectively bent clockwise or anti-clockwise through a prescribed angle with respect to the central portion 35 of that member 30. By welding its base end portion 34 to the outer side wall 22 of the mask frame 17 substantially parallel to the axis of the envelope, that is, of the color picture tube, the shadow mask support member 30 is attached to the mask frame 17 so that the second metal strip 32 thereof may be located at the side of the fluorescent screen 14. Note here that the base end portion 34 is welded to the outer side wall 22 at its several spots falling within the domain of the first elastic metal strip 31. On the other hand, in that portion of the tip end portion 36 of the shadow mask support member 30 which falls within the domain of the first elastic metal strip 31, a hole 37 is provided which is intended to be fitted over and engaged with the panel pin 20.

Since in the process of manufacturing the color picture tube the shadow mask 16 is repeatedly attached to and detached from the panel 11 and since the shadow mask support member 30 is desired to have a resistance to vibration, the shadow mask support member 30 is required to be an appreciably strong elastic member. Furthermore, the shadow mask support member 30, desirably, does not lose its elasticity even when it is subjected to thermal treatment at as high a temperature as 400°~450° C. in the process of manufacturing the color picture tube. Taking it into consideration that a cold-rolled steel plate used for the mask frame 17 has a thermal expansion coefficient of $120\times10^{-7}$/°C., this embodiment uses as the material of the first elastic metal strip 31 a product prepared by causing a Japanese Industrial Standard material of SUS 631 (17Cr-7Ni-Al-Fe having a thermal expansion coefficient $116\times10^{-7}$/°C.) to be precipitation-hardened at 1,000° C. and, after subjecting the material to rolling & molding process, subjecting the resultant material to one-hour annealing process under a temperature of 480° C. Since, in consideration of the thermal expansion coefficient of the glass constituting the panel 11, the panel pin 20 uses an alloy of 18Cr-Fe having a thermal expansion coefficient of around $115\times10^{-7}$/°C., it is preferable, for obtaining a good engagement between the shadow mask support member 30 and the panel pin 20, that the thermal expansion coefficient of the first elastic metal strip 31 is $100\sim130\times10^{-7}$/°C. approximate to that of said glass. The panel pin 20 has a tapered side wall onto which the shadow mask support member 30 is removably fitted through the hole 37. However, if there is a great difference in thermal expansion coefficient between the panel pin 20 and the shadow mask support member 30, the engaging portion of the latter 30 undesiredly cuts into the former 20, failing to hold the shadow mask assembly 18 precisely in preselected position. In this embodiment, however, the thermal expansion coefficient of said former 20 is chosen to have a value close to that of said latter 30. Thus, such an inconvenience as mentioned above does not occur. That is, in this embodiment, an alloy of 36Ni-64Fe (thermal expansion coefficient, $15\times10^{-7}$/°C.) such as invar is used for the third metal strip 33, while a material of SUS 302 (18Cr-8Ni-Fe having a thermal expansion coefficient of $173\times10^{-7}$/°C.) is used for the second metal strip 32.

Figure 4:
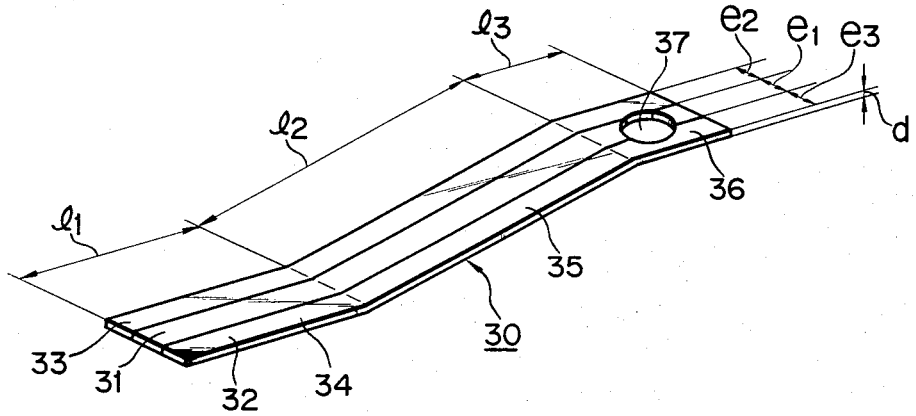
FIG. 4 is a perspective view showing an example of the shadow mask support member used in the color picture tube of the invention.

The shadow mask support member 30 used in the above-mentioned embodiment is for use in a color picture tube of 19 inches. As shown in FIG. 4, the metal strips 31, 32 and 33 thereof are chosen to have widths $e_1$, $e_2$ and $e_3$ of 5 mm, respectively, and a thickness d of 0.8 mm. And the base end portion 34, central portion 35 and tip end portion 36 thereof are chosen to have lengths $l_1$, $l_2$ and $l_3$ of 27 mm, 42 mm and 15 mm, respectively. The hole 37 is chosen to have a diameter of 8 mm. Note here that in the case of using invar as the material of the third metal strip 33, because of its being low in mechanical strength, it is preferable, in consideration of the mechanical strength of the shadow mask support member, that the width of the invar is chosen to be $\frac{1}{3}$ or less of the entire width of the shadow mask support member. In the shadow mask support member constructed as mentioned above, the first elastic metal strip 31 welded to the mask frame 17 and fitted onto the panel pin 20 has a thermal expansion coefficient substantially equal to that of the mask frame 17 and the panel pin 20. Therefore, in the thermal treatment under high temperature performed at the evacuation step of the manufacturing process of the color picture tube, the amounts of thermal expansion of the mask frame 17 and the shadow mask support member 30 at the welding spots 38 become substantially equal, thereby making extremely small the thermal stress acting on those welding spots due to a difference in thermal expansion coefficient, thus eliminating the fatal drawback of the prior art color picture tube that the positional relationship between the shadow mask 16 and the fluorescent screen 14 fails to remain fixed due to the permanent deformation of the mask frame 17 and the support member 30 at their welding portions. This makes it possible to omit the thermal treatment step regarded as being essential in the prior art, wherein the color picture tube is passed through a stabilizing oven. This contributes to a reduction in the manufacturing cost of the color picture tube. Further, according to the above-mentioned embodiment, since the shadow mask support member 30 is also substantially equal in thermal expansion coefficient to the panel pin 20, the former is less allowed, during the thermal treatment, to cut into the latter at the engaging portion. This shadow mask support member 30, therefore, can contribute, also after the thermal treatment of the color picture tube, to keeping the space interval between the shadow mask 16 and the fluorescent screen 14 to be fixed.

In the above-mentioned embodiment, the shadow mask support member 30 includes the three metal strips differring in thermal expansion coefficient from each other—the first, second and third metal strips. The compensation for the thermal expansion of the shadow mask occurring during the operation of the color picture tube may be also made by using a combined structure of two metal strips one of which has a thermal expansion coefficient substantially equal to that of the material of the mask frame 17 and the other of which is joined to said one metal strip at one side thereof and has a thermal expansion coefficient higher or lower than that of said one metal strip. In such a two-strip combined structure, however, the difference between the two metal strips in thermal expansion coefficient becomes unavoidably small. In order to make a complete compensation for the thermal expansion of the shadow mask against any temperature variation, therefore, it is necessary to cause an increase in the distance between the welding portion of the shadow mask support member 30 to the mask frame 17 and the engaging portion of the member 30 with the panel pin. That is, it is necessary to elongate the shadow mask support member 30. The elongated shadow mask support member 30, however, is easily deformable by undergoing a vibration of the color picture tube and does not satisfy the necessary requirements for supporting the shadow mask of heavy weight. In contrast, the shadow mask support member of this embodiment makes it possible to obtain the same amount of deformation as in case of a bimetal prepared by joining a metal strip of a thermal expansion coefficient higher than that of the mask frame to a metal strip of a thermal expansion coefficient lower than that of the mask frame in side by side joined relationship to each other. Thus, the shadow mask support member of this embodiment is neither required to be made elongate, nor deformed by undergoing a vibration of the color picture tube.

Figure 5:
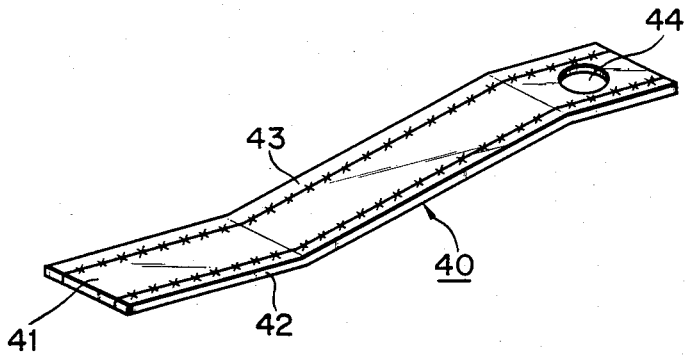
FIG. 5 is a perspective view showing another example of the shadow mask support member used in the color picture tube of the invention.

FIG. 5 shows the shadow mask support member according to another embodiment of the invention. A shadow mask support member 40 includes a first elastic metal strip 41 consisting of the SUS 631 material, a second metal strip 42 consisting of the SUS 302 material, and a third metal strip 43 consisting of invar. The metal strips 41, 42 and 43 are chosen to have widths of 8.8 mm, 3.8 mm and 3.8 mm, respectively. The hole 44 engaging the panel pin is so provided as to fall within the domain of the first elastic metal strip 41. Each of the metal strips 42 and 43 is joined to the first elastic metal strip 41 by being spot-welded at intervals of 1 mm as shown by the marks (x). Since in this embodiment the engaging hole 44 is provided within the domain of the first elastic metal strip 41, during the manufacture of the color picture tube the shadow mask support member 40 is less allowed to cut into the panel pin. Further, at the joining portion of the metal strip 41 to each of the metal strips 42 and 43, since there exists only a small difference in respect of thermal expansion coefficient between the two adjacent metal strips, the thermal stress is weak even if the shadow mask support member is thermally deformed. At said joining portion, therefore, the two adjacent metal strips are not required to be firmly joined on a continuous basis. Thus, the shadow mask support member is given a sufficiently high mechanical strength by the spot-welding as in this embodiment. As mentioned above, where two adjacent metal strips are joined together by the spot-welding technique, the welding operation is simple and can be performed in a short time. Therefore, during its manufacture, the shadow mask support member is not deformed, thereby obtaining a highly precise and inexpensive shadow mask support member. Note here the following. Where the metal strips of the shadow mask support member structure shown in FIG. 4 are joined together by being spot-welded as shown in FIG. 5, since the hole 37 engaging the panel pin is provided extending over the three metal strips, it is desirable in consideration of the mechanical strength of the structure that the tip end portion 36 thereof is welded on a continuous basis.

Figure 6:
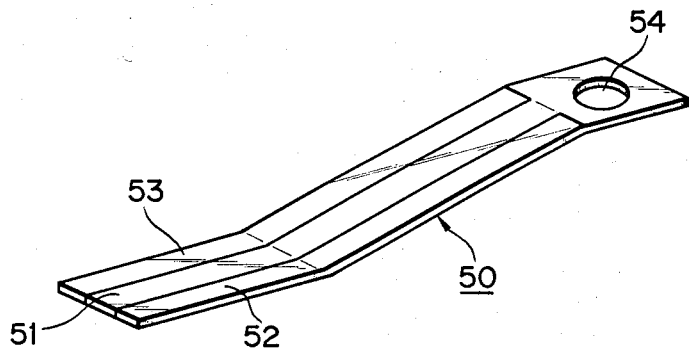
FIG. 6 is a perspective view showing still another example of the shadow mask support member used in the color picture tube of the invention.

A shadow mask support member 50 shown in FIG. 6 is formed with an engaging hole 54 to engage the panel pin, so as to permit the hole 54 to fall within the domain of the first elastic metal strip 51 as in case of the support member 40 shown in FIG. 5. In the shadow mask support member 40 of FIG. 5, however, a wide first elastic metal strip 51 must be employed. This necessitates the use of narrow second and third metal strips 42 and 43. As a result, it is possible that the member 40 becomes short of the amount of deformation. To eliminate this possibility, the shadow mask support member shown in FIG. 6 is made to have the following construction. The three metal strips are chosen to have the same width as in case of the shadow mask support member of FIG. 4 excepting that the central first elastic metal strip is made wide only at its end portion formed with a hole 54 engaging the panel pin. And second and third metal strips 42, 43 made shorter by the longitudinal length of said widened end portion of the central first elastic metal strip are joined at one end to the inner edges of said widened end portion thereof.

Figure 7:
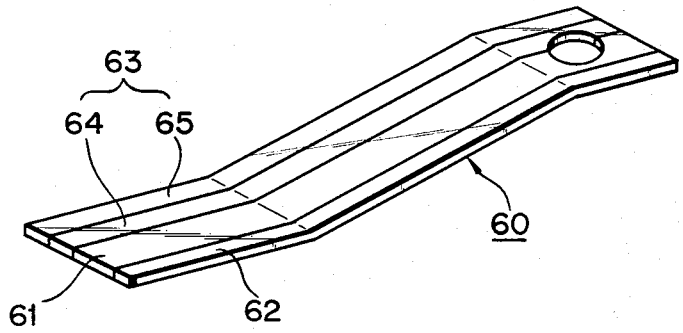
FIG. 7 is a perspective view showing a further example of the shadow mask support member used in the color picture tube of the invention.

FIG. 7 shows a shadow mask support member according to a further embodiment of the invention. In this embodiment, the third metal strip is comprised of two metal strips differring in respect of thermal expansion coefficient. That is, the third metal strip 63 is comprised of a metal strip 64 consisting of invar material and another metal strip 65 consisting of metal material having a low thermal expansion coefficient (an alloy of Ni 32-Co14-Ti 1.6-Fe having a thermal expansion coefficient of $58\times10^{-7}$/°C., precipitation-hardened at 800° C. for 30 min. and then annealed at 600° C. for 24 hours). The first elastic metal strip 61 and the second metal strip 62 consist of the materials SUS 631 and SUS 302, respectively. The metal strips 64, 65, 61 and 62 are chosen to have widths of 3 mm, 3 mm, 5 mm and 3 mm, respectively. Any two adjacent metal strips are joined by being seam-welded at their entire joining sides. According to this embodiment, the smaller amount of invar having a weak spring characteristic can be employed. Thus is obtained a color picture tube provided with a shadow mask support member having higher resistance to the vibration of the color picture tube.

What we claim is:

1. A color picture tube comprising:

a shadow mask assembly having a shadow mask with a large number of apertures permitting the passage of electron beams therethrough and a mask frame for holding the shadow mask at the peripheral edge thereof;

an envelope having a face panel and a fluorescent screen on an inner surface of said panel;

at least two pins built in an inner surface of said envelope; and at least two supporting members for supporting the shadow mask assembly so as to permit said shadow mask to oppose the fluorescent screen inside the envelope in face to face relationship, each supporting member including a first metal strip having a thermal expansion coefficient substantially equal to that of said mask frame, said first metal strip being fixed at one end portion thereof to said mask frame and engaged at the other end portion thereof with one of said pins, a second metal strip joined to said first metal strip at one side thereof so that their respective faces may form a continuous face and having a thermal expansion coefficient higher than that of said first metal strip, and a third metal strip joined to said first metal strip at the other side thereof so that their respective faces may form a continuous face and having a thermal expansion coefficient lower than that of said first metal strip.

2. The color picture tube according to claim 1 wherein said first metal strip has a thermal expansion coefficient of $100\sim130\times10^{-7}$/°C.; said second metal strip has a thermal expansion coefficient of $150\times10^{-7}$/°C. or more; and said third metal strip has a thermal expansion coefficient of $80\times10^{-7}$/°C. or less.

3. The color picture tube according to claim 1 wherein said mask frame consists of iron; said first and second metal strips consist respectively of different types of stainless steel; and said third metal strip consists of invar steel.

4. The color picture tube according to claim 1 wherein any two adjacent metal strips of said first, second and third metal strips are locally joined together at many points of their joining sides.

5. The color picture tube according to claim 1 wherein each supporting member is formed with an engaging hole at its said other end portion; and said one pin is fitted into said engaging hole.

6. The color picture tube according to claim 5 wherein said engaging hole is formed only in said first strip.

7. The color picture tube according to claim 6 wherein the portion of said first metal strip which is formed with said engaging hole is made wide to be equal to the entire width of the shadow mask supporting member.

8. The color picture tube according to claim 1 wherein said third metal strip consists of two metal strips differring in respect of thermal expansion coefficient.

9. The color picture tube according to claim 1 wherein said first metal strip has a thermal expansion coefficient whose value is between the value of the thermal expansion coefficient of said one pin and that of the thermal expansion coefficient of said mask frame.

10. The color picture tube according to claim 3 wherein the width of said third metal strip is not greater than $\frac{1}{3}$ of the entire width of said shadow mask supporting member.

* * * * *